US007819381B2

(12) United States Patent
Abe

(10) Patent No.: US 7,819,381 B2
(45) Date of Patent: Oct. 26, 2010

(54) CONNECTOR TO BE ATTACHED TO LIQUID TANK AND LIQUID TANK PROVIDED WITH THE CONNECTOR

(75) Inventor: Koichi Abe, Gyoda (JP)

(73) Assignee: Surpass Industry Co., Ltd., Saitama (JP)

( * ) Notice: Subject to any disclaimer, the term of this patent is extended or adjusted under 35 U.S.C. 154(b) by 750 days.

(21) Appl. No.: 11/628,241

(22) PCT Filed: May 27, 2005

(86) PCT No.: PCT/JP2005/009803

§ 371 (c)(1),
(2), (4) Date: Dec. 1, 2006

(87) PCT Pub. No.: WO2005/119115

PCT Pub. Date: Dec. 15, 2005

(65) Prior Publication Data

US 2008/0272323 A1 Nov. 6, 2008

(30) Foreign Application Priority Data

Jun. 1, 2004 (JP) ..... 2004-163395

(51) Int. Cl.
*F16K 51/00* (2006.01)

(52) U.S. Cl. ..... 251/144; 251/149.6

(58) Field of Classification Search ..... 251/144, 251/149.6; 137/614.04; 222/400.7
See application file for complete search history.

(56) References Cited

U.S. PATENT DOCUMENTS 3,357,602 A * 12/1967 Sichler ..... 222/400.7
RE27,626 E * 4/1973 Johnston ..... 222/400.7
3,905,522 A * 9/1975 Johnston ..... 222/400.7
4,643,825 A * 2/1987 Weslowski ..... 210/188
5,108,015 A * 4/1992 Rauworth et al. ..... 222/400.7
5,335,821 A * 8/1994 Osgar ..... 222/83
5,435,460 A * 7/1995 Osgar ..... 222/1
5,526,956 A * 6/1996 Osgar ..... 222/83
5,971,019 A * 10/1999 Imai ..... 137/614.04
6,015,068 A * 1/2000 Osgar et al. ..... 222/400.7
6,302,148 B1 * 10/2001 Imai ..... 137/614.04
6,412,666 B1 * 7/2002 Hogan et al. ..... 222/325
6,505,863 B2 * 1/2003 Imai ..... 285/316
6,523,861 B1 * 2/2003 Clancy et al. ..... 285/93

(Continued)

*Primary Examiner*—John K Fristoe, Jr.
*Assistant Examiner*—Marina Tiet Jen
(74) *Attorney, Agent, or Firm*—Browdy and Neimark, PLLC

(57) ABSTRACT

The object is to provide a connector to be attached to a liquid tank, which reduces a trouble of arranging a plug, is advantageous in cost and capable of preventing misconnection, is provided by compactly integrating two types of plugs, which are a liquid delivery plug and a gas feeding plug. The connector is to be attached to a liquid tank for delivery of an internal liquid, and is constructed of: a plug (1) fixedly mounted on the tank; and, a corresponding socket (2) connected thereto. The connector is characterized by the plug (1) and the socket (2), wherein: the plug (1) is provided with a liquid passage (8) and a gas passage (12); and, the socket (2) is provided with: a liquid passage (38) communicating with the liquid passage (8); a liquid passage connecting piece (21) communicating with the liquid passage (38); a gas passage (34) communicating with the gas passage (12); and, a gas passage connecting piece (37) communicating with the gas passage (34).

11 Claims, 9 Drawing Sheets

U.S. PATENT DOCUMENTS 6,568,427 B2 * 5/2003 Imai ..... 137/590
6,634,396 B2 * 10/2003 Ozawa ..... 141/326
6,675,833 B2 * 1/2004 Maldavs ..... 137/614.05
6,681,803 B2 * 1/2004 Taneya et al. ..... 137/614.03

* cited by examiner

CONNECTOR TO BE ATTACHED TO LIQUID TANK AND LIQUID TANK PROVIDED WITH THE CONNECTOR

TECHNICAL FIELD

The present invention relates to a connector and a liquid tank provided with the connector to be attached to the tank, wherein: stored in the tank is a liquid such as semiconductor high-purity chemicals and ordinary chemicals; and, the connector is constructed of both a plug and a socket each used for delivery of the liquid.

BACKGROUND ART

In general, semiconductor high-purity chemicals and ordinary chemicals are stored in a tank good in resistance to these chemicals. As shown in FIG. 11, hitherto it has been known in the art that: formed in this tank 70 are two pieces of mouth stopper portions 71 and 71*a*; and, plugs 72 and 72*a* are mounted on these mouth stopper portions 71 and 71*a*, respectively, wherein each of the plugs 72 and 72*a* is provided with a plug portion not shown in the drawings. These plugs 72 and 72*a* function as lids for closing the mouth stopper portions 71 and 71*a*, respectively. Of these plugs 72 and 72*a*: one serves as a liquid passage connecting piece 72; and, the other serves as a gas passage connecting piece 72*a*. Connected with the liquid passage connecting piece 72 is a siphon tube 73 which reaches in the vicinity of a bottom portion of the tank 70.

Further, in this kind of tank 70, a cap is mounted on a plug portion of each of the plugs 72 and 72*a*, which are mounted on the mouth stopper portions 71 and 71*a* of the tank, respectively, so that a through hole formed in each of the plug portions is closed by means of this cap. Under such circumstances, the tank is carried or reserved.

In retrieving the liquid stored in this tank 70, first of all, the caps having been mounted on the plug portions of the plugs 72, 72*a* provided in the mouth stopper portions 71, 71*a* in the tank 70 are removed. After that, each of sockets 75, 75*a* having been connected with a hose 74 is connected with each of the plug portions of these plugs 72, so that the liquid contained in the tank 70 is retrieved and supplied to the hose 74 through the siphon tube 73 by using a pump P. At this time, in order to prevent the interior of the tank 70 from falling in negative in pressure, an inert gas is supplied to the tank 70 from a hose 74*a* having been connected with the plug portion of the other plug 72*a*.

In some instance, the liquid stored in the tank 70 vaporizes with the lapse of time. Consequently, there is a fear that the pressure inside the tank 70 increases in use. Due to this, a tank and a plug, which is used in the tank, each improved in safety and free from a fear that the liquid flows out of the tank under the influence of the pressure inside the tank 70 in use, have been proposed (Japanese Patent application Laid-Open No.: 2002-114242 gazette).

Further, in Japanese Patent application Laid-Open No.: 2002-54782 gazette, there is disclosed a tube joint which is capable of: reducing the amount of air mixing into the liquid when the socket is connected with the plug as small as possible; and, preventing the liquid from leaking from the socket and the plug when the socket is separated from the plug.

Incidentally, in order to prevent the sludge having been precipitated out of a liquid chemical in the tank from increasing in volume, in recent years, the need to circulate the liquid chemical at a time when the liquid chemical stored in the tank is not delivered exists in the art. In this circulation of the liquid chemical, the liquid chemical having been retrieved from the tank through the siphon tube is returned to the interior of the tank. In a conventional tank, its gas plug which is small in its inner diameter suffices only for pressure feed of the gas. However, such gas plug is too small in diameter when used also in circulation of the liquid chemical, and therefore can't be used to realize a smooth circulation of the liquid chemical.

Patent document 1: Japanese Patent application Laid-Open No.: 2002-114242 gazette; and Patent document 2: Japanese Patent application Laid-Open No.: 2002-54782 gazette.

DISCLOSURE OF THE INVENTION

Problems to be Solved by the Invention

In any one of the tank and the plug described in the above, two openings each for each of the liquid delivery use and the gas feed use are independently formed, wherein: in these openings, there are individually installed both a liquid delivery plug and a gas feed plug. Due to this, such installation of the individual plugs takes too much labor and cost. Further, the conventional tank described in the above has the disadvantage that the liquid stored in the tank can't be circulated.

Consequently, it is an object of the present invention to provide both a connector to be attached to a liquid tank and the liquid tank itself, wherein: according to the present invention, two kinds of plugs described above are integrated in a compact manner to reduce in labor in installation of these plugs; further, it is possible to prevent the plugs from be improperly connected, and also possible to be advantageous in cost in realizing such prevention of improper connection; further, it is also possible to realize the circulation of the liquid stored in the tank; and, still further, the connector to be attached to the liquid tank is capable of performing a dust protective function.

Means for Solving the Problems

A connector of the present invention for solving the problems described above is one to be attached to a mouth stopper portion of a liquid tank for delivery of an internal liquid stored in the interior of the liquid tank, characterized in that: the connector is constructed of a plug fixedly mounted on the tank and a socket connected with the plug; the plug is provided with a liquid passage and a gas passage; and, the socket is provided with a liquid passage communicated with the liquid passage and also provided with a liquid passage connecting piece communicated with the liquid passage, and further provided with a gas passage communicated with the gas passage and also provided with a gas passage connecting piece communicated with the gas passage.

Further, a connector of the present invention to be attached to a liquid tank for solving the problems described above is one to be attached to a mouth stopper portion of the liquid tank for delivery of an internal liquid stored in the interior of the liquid tank, characterized in that: the connector is constructed of a plug fixedly mounted on the tank and a socket connected with the plug; the plug is provided with a plug portion provided with a engagement means engaging with the socket, and is provided with a siphon tube and a fitting means to be fixed to the tank; formed in the plug portion are a liquid passage and a gas passage; and, the socket is provided with an engagement means engaged with the plug and also provided with a valve unit together with a liquid passage and a liquid passage connecting piece communicated with the liquid passage, and further provided with a gas passage and a gas passage connecting piece communicated with the gas passage, wherein the valve unit is constructed of: a sleeve element provided with a valve seat in its lower portion; a valve disposed inside the sleeve element; and, a spring for urging the valve seat, wherein: the gas passage is so formed as to vertically extend along an outer side of the sleeve element and also to be communicated with the gas passage connecting piece; and, when the valve is opened, the liquid passage disposed in the side of the plug is permitted to communicate with the liquid passage disposed in the side of the socket, wherein the gas passage disposed in the side of the socket is permitted to communicate with the gas passage disposed in the side of the plug.

Preferably: the plug is provided with a plug cap which covers the plug portion at a time when the socket is not connected; a color ring is fitted in an opening in an upper surface of the plug, wherein the color ring is classified in color in accordance with the kinds of the liquid in the tank; a key is formed in the opening in the upper surface of the plug, wherein the key has its installation position varied in accordance with the kind of the liquid stored in the tank; and, an upper end of the gas passage having been formed in the plug portion is opened into an upper side surface of the plug portion.

Further, the socket is constructed of: a sleeve; an inner tube, which is slidably inserted in the sleeve and has its inner peripheral surface formed into the gas passage; a valve unit installed inside the inner tube; the liquid passage connecting piece for supporting an upper surface of the valve unit; and, the gas passage connecting piece mounted on an upper portion of the inner tube. Further, preferably one or a plurality of gas passages are formed in an outer side of the sleeve element, wherein an upper end of each of the gas passages is opened into an annular gap formed between the inner tube and the liquid passage connecting piece.

The plug is provided with a male screw portion in its intermediate portion, wherein: the male screw portion is threadably engaged with a mouth stopper portion of an upper surface of the tank; and, a bulging portion which bulges out over an edge portion of the mouth stopper portion is provided in an upper portion of the plug; and, the bulging portion is covered with a dust protective cap.

The liquid tank of the present invention for solving the problems described above is provided with two pieces of mouth stopper portions in its upper surface, wherein: provided in at least one of the mouth stopper portions is any one of the connectors described above.

Effect of the Invention

In the connector of the present invention, the plug and the socket each for the liquid passage connection and the plug and the socket each for the gas passage connection are integrated in a compact manner. Due to this, there is no need of connecting the plug with the socket in the side of the gas and no need of connecting the plug with the socket in the side of the liquid too. Only a singe connecting operation performed in the side of the liquid makes it possible to deliver the liquid. Consequently, it is possible to reduce labor in half. This makes the connector of the present invention advantageous in cost too. Further, in the conventional system described above, it is also possible to realize the circulation of the liquid of the tank even when the conventional system is still used in the side of the liquid, provided that the connector of the present invention is connected in the side of the gas (FIG. 10 described later) This is an advantageous effect obtained in the present invention.

Particularly, in the inventions described in claims 4 and 5, it is possible to prevent an improper connection between the plug and the socket from occurring, without fail. Further, in the invention described in claim 9, it is possible to obtain an effect in preventing the dust from entering the interior of the plug when a drum is transported. In the present inventions described in claim 10 and 11, it is possible to circulate the liquid of the tank and thereby allowing the liquid to be kept in purity and in concentration. This makes it possible to stabilize a process subsequent to such circulation of the liquid. This is another effect obtained in the present invention.

BEST MODE FOR CARRYING OUT THE INVENTION

Preferred embodiments for carrying out the present invention will be described with reference to the accompanying drawings. FIG. 1 is a longitudinal sectional view illustrating in construction a connector constructed of both a plug 1 and a socket 2 each constructed according to the present invention. FIG. 2 is a longitudinal sectional view of the plug 1. FIG. 3 is a plan view of the plug 1. FIG. 4 is a longitudinal sectional view of the socket 2.

First, with reference to FIGS. 1 to 3, the plug 1 will be described in construction. The plug 1 is constructed of a cup-like body 3. A siphon tube 5 is integrally formed with the body 3. Alternatively, the siphon tube 5 may be independently formed and thereafter welded to the body 3. When the connector of the present invention is attached to the tank, the siphon tube 5 extends to the vicinity of the bottom of the tank.

Vertically provided in a central area of a concave portion 7 of the body 3 is a plug tube 6. The plug tube 6 is formed into a cylindrical shape provided with a through hole 8, which hole 8 communicates with the siphon tube 5. Both an annular engagement groove 9 and an annular engagement ridge 10 are formed in an outer peripheral surface in an intermediate portion of the plug sleeve 6. Formed in an outer peripheral surface of a lower portion of the plug tube 6 is a male screw 11. Fitted into the engagement groove 9 is a locking ball 26 (described later) of the socket 2. One or a plurality of gas passages 12 vertically pass through the plug tube 6 and also pass through a bottom portion of the body 3. An upper end of the gas passage 12 is so opened as to communicate with a side surface of an upper portion of the plug tube 6.

A color ring 13 is fitted in an opening portion provided in an upper surface of the body 3. The color ring 13 is one carrying a color corresponding to a predetermined color for indicating a liquid (or a contained liquid) stored in the tank. Further, the color ring 13 is provided with a plurality of keys 14, which vary their installation positions according to various kinds of the contained liquid. Though the keys 14 fulfill the function of identifying the contained liquid as in the case of coloring the keys 14, it is a primary object of the keys 14 to prevent the socket 2 from being connected to a wrong one of the plugs 1. In other words, the socket 2 is provided with a plurality of key grooves, which are formed in the socket 2 to correspond to the keys 14 thereby allowing only a predetermined socket 2 to connect with the plug 1 to which the color ring 13 carrying a certain color is fitted.

In FIG. 2, there is shown a plug cap which is denoted by the reference numeral 15. The plug cap 15 is one which covers the plug tube 6 to protect the plug tube 6 from damage when the socket 2 is not connected. Formed in an inner peripheral surface of a lower portion of the plug cap 15 is a female screw, which screw is threadably engaged with the male screw portion 11 of the plug tube 6, so that the plug cap 15 is attached to the plug tube 6.

Next, with reference to FIGS. 1 and 4, the socket 2 will be described in construction. The socket 2 is provided with: a sleeve 18 provided with a flange in its upper terminal; an inner tube 19 slidably inserted in the sleeve 18; a valve 20 mounted in the inner tube 19; and, a liquid passage connecting piece 21, which is threadably engaged with the inner tube 19.

An outer peripheral surface of a lower portion in the inner tube 19 is reduced in thickness to form a shoulder portion 22. A spring 23 is wound around an upper half portion of such reduced thickness portion. An upper surface of the spring 23 is received by the shoulder portion 22. On the other hand, a lower surface of the spring 23 is received by a spring receiving ring 24, which ring 24 is fitted in a lower portion of the sleeve 18.

A plurality of ball engaging holes 25, each of which divergently opens outwardly and assumes an elongated circular shape, are arranged side by side so as to be spaced apart from each other at appropriate intervals. The ball 26 is fitted in each of the ball engaging holes 25. Arranged in the inner tube 19 is a sleeve element 27. The element 27 has its upper portion fixedly mounted in a lower end portion of the connecting piece 21. In general, the sleeve element 27 is provided with a bellows 28 in its intermediate portion thereby allowing such intermediate portion to be extensible and retractable in operation. A lower portion of the sleeve element 27 is formed into a valve seat 29 for receiving a valve head 30 therein, wherein the valve seat 29 flares outwardly. The valve seat 29 assumes a cone-shaped form which flares downward to provide a tapered surface. Seated on such a tapered surface is the valve head 30 used to close the valve. When the valve head 30 is separated from the tapered surface, the valve is opened. Further, the valve seat 29 has its upper surface receive a valve spring 31.

By threadably engaging the connecting piece 21 with the inner tube 19 from above, the connecting piece 21 is mounted in the inner tube 19. The valve 20 is fixedly mounted on a lower bottom surface of the connecting piece 21. In addition, a plurality of liquid communication passages 33 are so formed as to surround such valve's fixedly mounted portion. Through these liquid communication passages 33, the connecting piece 21 has its interior space communicated with the corresponding interior space of the sleeve element 27.

Further, the connecting piece 21 has its bottom surface brought into press-contact with the valve spring 31 thereby allowing a resilient force of the valve spring 31 to be always applied to the valve seat 29. As a result, the valve seat 29 is brought into close contact with the valve head 30 to achieve a liquid-tight engagement with the valve head 30. In this connection, as described later, when the valve seat 29 is pushed upward and is thereby separated from the valve head 30, the separated area of the liquid passage permits the liquid to flow through this separated area of the liquid passage.

One or a plurality of longitudinal grooves are formed in an inner side surface of the inner tube 19, and vertically extend to form a gas passage 34. The gas passage 34 has its lower end opening portion opened up when the valve 20 is closed, so that the opening portion thus opened up is permitted to communicate with the gas passage 12 of the plug 1.

Further, the gas passage 34 has its upper end opening portion opened to an annular gap 35. The gap 35 is formed between an inner peripheral surface of the head portion of the inner tube 19 and an outer peripheral surface of the connecting piece 21. Formed in the head portion of the inner tube 19 is a plug hole 36, which is communicated with the annular gap 35. Threadably engaged with the plug hole 36 is a gas fluid passage connecting piece 37.

FIGS. 5 to 8 are ones which illustrate a method for connecting the plug 1 with the socket 2 each having the above-mentioned construction, wherein: the plug 1 is previously threadably engaged with a mouth stopper portion 48 provided in an upper surface 47 of the tank in a condition in which the plug sleeve 6 has been already covered with the plug cap 15; under such circumstances, first of all, the plug cap 15 is removed therefrom (FIG. 5); and, after that, the socket 2 is fitted in there from above (FIG. 6).

As a result, the plug sleeve 6 is fitted in a lower portion of the inner sleeve 19 (FIG. 7). This causes the ball 26, which has been slightly projected inwardly from the ball engaging hole 25, to hit the engagement ridge 10 of the plug sleeve 6 (FIG. 8). As a result, the ball 26 is temporarily moved outward by the ridge 10. However, when the socket 2 is further pushed in, the ball 26 is forced to ride on and pass through the ridge 10 thereby allowing the ball 26 to be slipped into the engagement groove 9 (FIG. 1). As a result, the socket 2 is locked up by the ball 26, and therefore can not be easily pulled out of the plug 1 thereafter.

In order to unlock the socket 2 thus locked, it is necessary to pull up the sleeve 18 relative to the inner sleeve 19 against the resilient force of the spring 23 by grasping and pulling up the upper end flange of the sleeve 18 relative to the inner sleeve 19 thereby allowing the ball 26 to be pushed back or inward.

In general, the socket 2 is connected with the plug 1 in a condition in which: the connecting piece 21 is previously connected with the liquid passage; and, the other connecting piece 37 is connected with the gas passage.

Upon completion of connection between the socket 2 with the plug 1, the plug sleeve 6 has its head surface abut against the valve seat 29 so that the valve seat 29 is pushed upward against a resilient force exerted by the valve spring 31. When the valve seat 29 is thus pushed upward, the bellows 28 having been disposed on the upper side of the valve seat 29 is compressed thereby allowing the valve seat 29 to be displaced upward and therefore separated from the valve head 30. Due to this, a liquid passage 38 is formed between the valve head 30 and the valve seat 29 (see FIG. 1). Thus, a liquid passage is constructed of: the siphon tube 5; the through hole 8 of the plug sleeve 6; the liquid passage 38; the interior of the sleeve element 27; the liquid communication passages 33; and, the connecting piece 21. This allows the liquid passage thus constructed to deliver the liquid of the tank.

Further, at a time when the socket 2 is connected with the plug 1, the gas passage 12 of the plug sleeve 6, which passage 12 opens into the interior of the tank, communicates with each of the gas passage 34 and the connecting pieced 37, wherein the connecting pieced 37 is connected with the gas passage 34. Consequently, an inert gas is supplied to the interior of the tank through these gas passages from the connecting piece 37 thereby allowing the interior the tank to prevent its pressure from decreasing.

In the embodiments described above, as is clear from the drawings, the upper surface of the plug 1 is flushed with the height of the upper surface 47 of the tank without projecting from the upper surface 47 of the tank. In the above construction described in a condition in which the socket 2 is not connected with the plug 1, there is a fear that dust enters the interior of the plug 1 and is deposited therein. In other words, as shown in FIG. 2, at a time when the socket 2 is not connected, the plug sleeve 6 is covered with the plug cap 15. The cap 15 is however used only to protect the plug sleeve 6 from damages, and does seal the concave portion 7 so that the plug cap 15 fails to prevent the dust from entering the interior of the concave portion 7.

An embodiment shown in FIG. 9 is one capable of solving this dust problem. In the embodiment, the male screw portion 4, which is threadably engaged with the mouth stopper portion 48 provided in an upper surface 47 of the tank, is disposed in the intermediate portion of the plug 1. An upper portion of the plug 1 bulges outward to form a bulging portion 39, a diameter of which is larger than an inner diameter of the mouth stopper portion 48, wherein the bulging portion 39 is covered with the dust cap 41.

The dust cap 41 may be one, a type of which is merely fitted to a non-slip rib portion and the like formed inside the dust cap 41. Preferably, the dust cap 41 may be one in which: a male screw 42 is formed in an outer peripheral surface of the bulging portion 39, with which male screw 42 the dust cap 41 is threadably engaged (see FIG. 9). Alternatively or preferably, the dust cap 41 may be another one, in a type of which: a single or few of annular engagement rings are formed in an outer peripheral surface of the bulging portion 39; an engagement ridge is formed in an inner surface of the dust cap 41; and, the engagement ridge is pushed in so as to be brought into press-fit engagement with the engagement rings (a so-called "snap-fit type").

In the case where any one of the above-mentioned types of the dust cap 41 is used to cover the bulging portion 39 therewith, the bulging portion 39 is entirely covered to prevent the dust from entering the interior of the plug 1, without fail. Further, due to the presence of the bulging portion 39, it is possible to prevent the plug 1 from being excessively fastened to the mouth stopper portion 48 since the bulging portion 39 abuts against an edge portion of the mouth stopper portion 48 to function as a stopper at a time when the plug 1 is threadably engaged with the mouth stopper portion 48.

Although the above-mentioned dust protective means is one primarily used in the case where the mouth stopper portion 48 does not project outward from the upper surface 47 of the tank, it is also possible to employ the dust protective means in construction even in the case where the mouth stopper portion 48 projects outward from the upper surface 47 of the tank. Incidentally, in the case where the mouth stopper portion 48 projects outward from the upper surface 47 of the tank, a screw or the like may be formed in the outer peripheral surface of the mouth stopper portion 48 without providing the bulging portion 39, and covered with the dust cap 41.

Further, it is also possible to use the above-mentioned dust protective means in another type of connector in addition to the connector of the present invention shown in FIG. 9(A). In other words, FIG. 9(B) shows an example in which the plug in the side of gas assumes another mode. Although not shown in the drawings, it is also possible to use any other mode of the plug in the side of the liquid.

FIG. 10 illustrates in construction an example of the liquid tank 46 according to the present invention, wherein the tank 46 is provided with the above-mentioned connector 45 according to the present invention. This liquid tank 46 is provided with two pieces of such mouth stopper portions 48, 48*a* in its upper surface 47. Connected to at least one of these portions 48, 48*a* is the connector 45 of the present invention.

In the example shown in FIG. 10: connected to one 48*a* of the mouth stopper portions 48, 48*a* is the liquid passage connecting connector 49 which is conventional in construction; and, connected the other 48 of the mouth stopper portions 48, 48*a* is the connector 45 of the present invention. In this case, there is provided a circulating 15 liquid passage 50 through which the connecting piece 21 connected to the liquid passage is connected to the connector 49. Incorporated in the circulating liquid passage 50 are: a valve 50; a pump 52; and, a filter 53. Further added to a main liquid passage 54 is a valve 55.

In the case of this liquid tank 46, when a normal delivery operation of the liquid is conducted: the valve 55 of the main liquid passage 54 is opened, and simultaneously the valve 51 is closed to stop the pump 52 so that communication of the liquid to the circulating fluid passage 50 is blocked up. As a result: the connector 45 functions as gas supply means only; and, the liquid stored in the liquid tank 46 is delivered when the pump 56 provided in the side of the main liquid passage 54 is operated.

In the circulating operation: the valve 55 is closed to stop the pump 56; and, the valve 51 provided in the side of the circulating liquid passage 50 is opened to operate the pump 52. Under such circumstances, the liquid having been drawn up through the connector 49 is guided to the circulating liquid passage 50 to flow to the filter 53, so that the liquid is kept in its purity and returned to the liquid tank 46 through the connector 45.

Due to this circulating operation, it is possible to prevent the liquid such as a slurry liquid and like liquid excellent in precipitability from precipitating thereby allowing the liquid: to widely spread; and, to be kept in purity and in concentration, which makes it possible to stabilize any subsequent processes.

While the present invention has been described in detail to some extent with reference to the preferred embodiments thereof, it will be understood by those skilled in the art that various changes inform and details may be made therein without departing from the spirit and scope of the present invention as defined by the appended claims. In other words, the present invention is not limited in scope by its specified embodiments.

Figure 1:
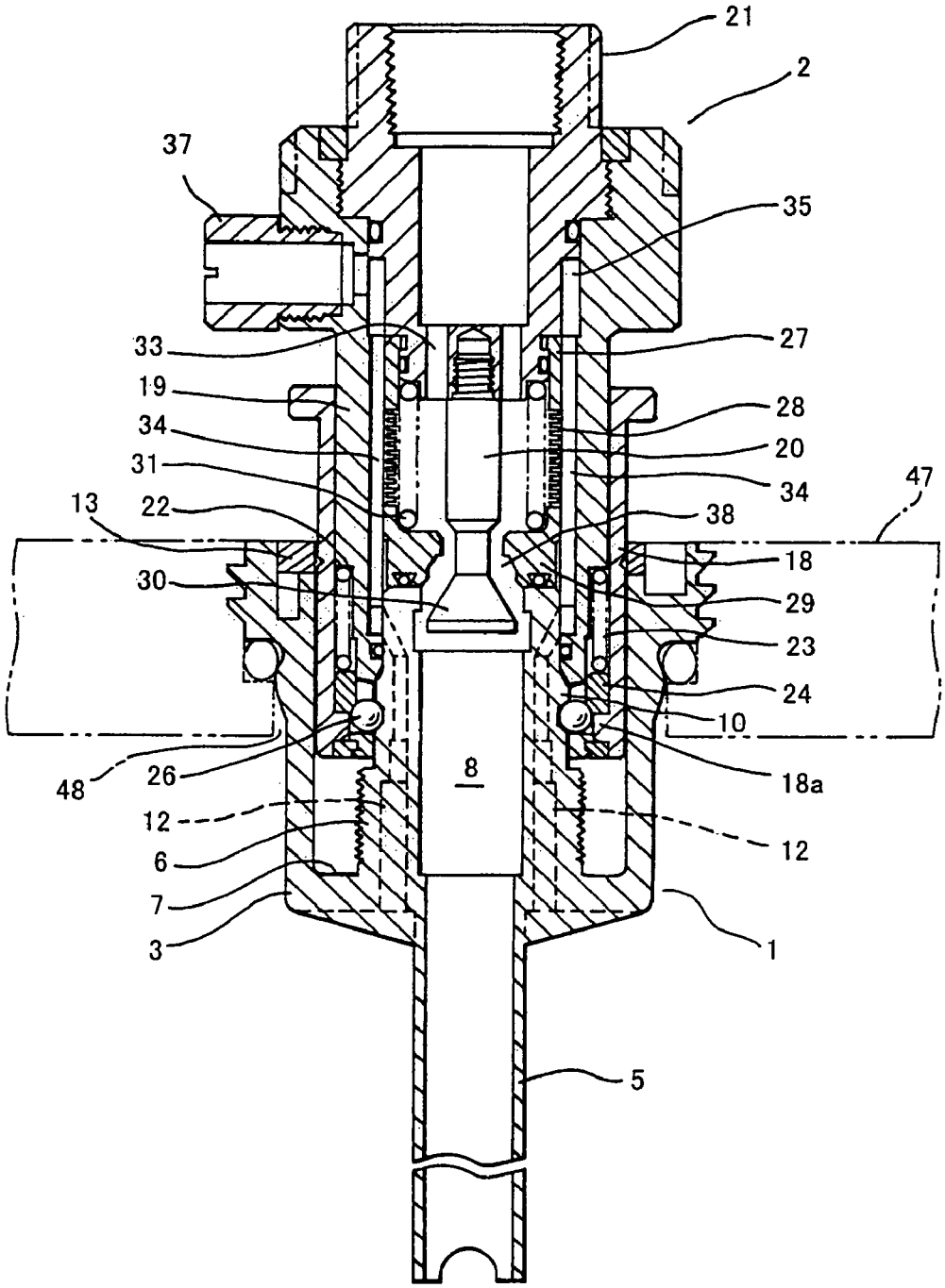
FIG. 1 is a view illustrating a connected condition of the plug and the socket of the connector according to the present invention.
Figure 2:
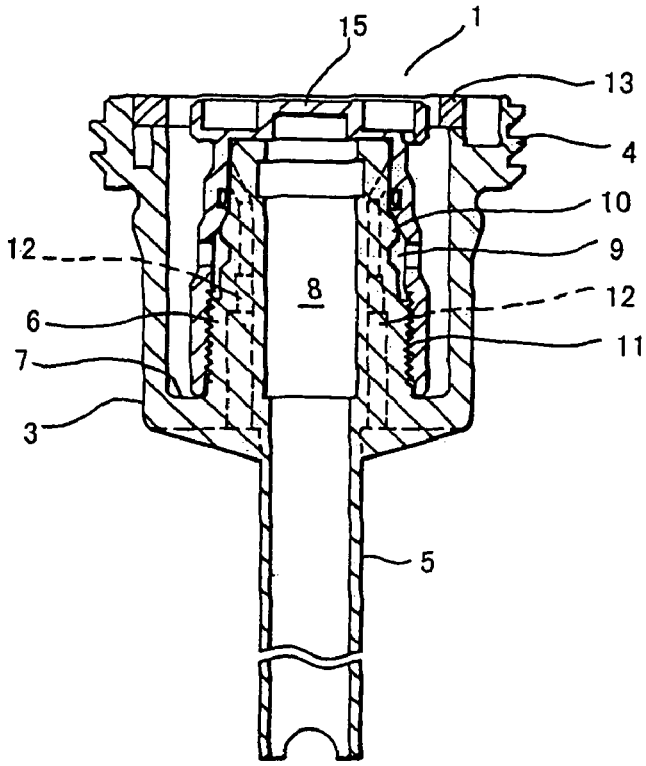
FIG. 2 is a longitudinal sectional view of the plug in the connector according to the present invention.
Figure 3:
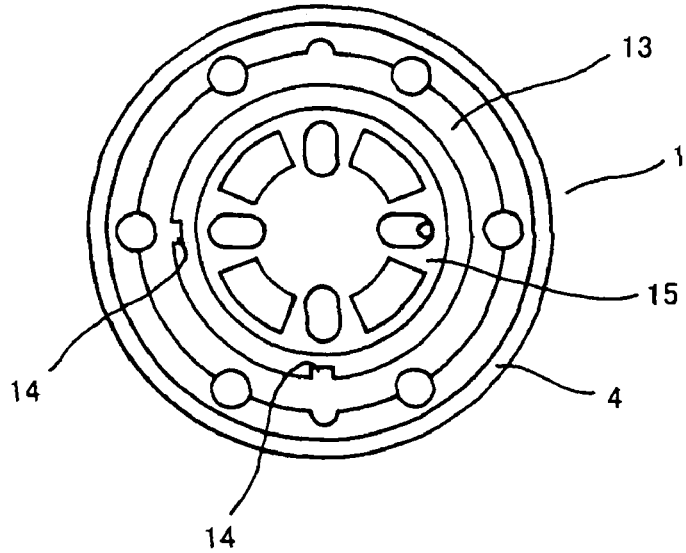
FIG. 3 is a plan view of the plug in the connector according to the present invention.
Figure 4:
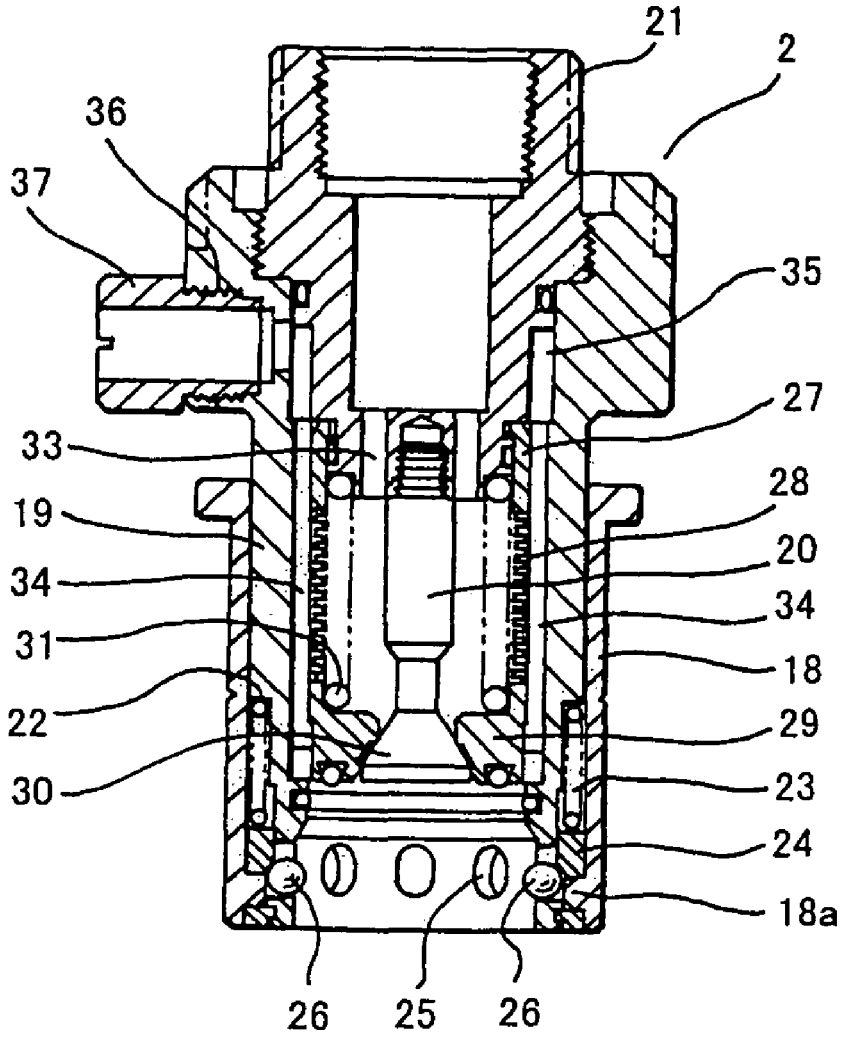
FIG. 4 is a longitudinal sectional view of the socket in the connector according to the present invention.
Figure 5:
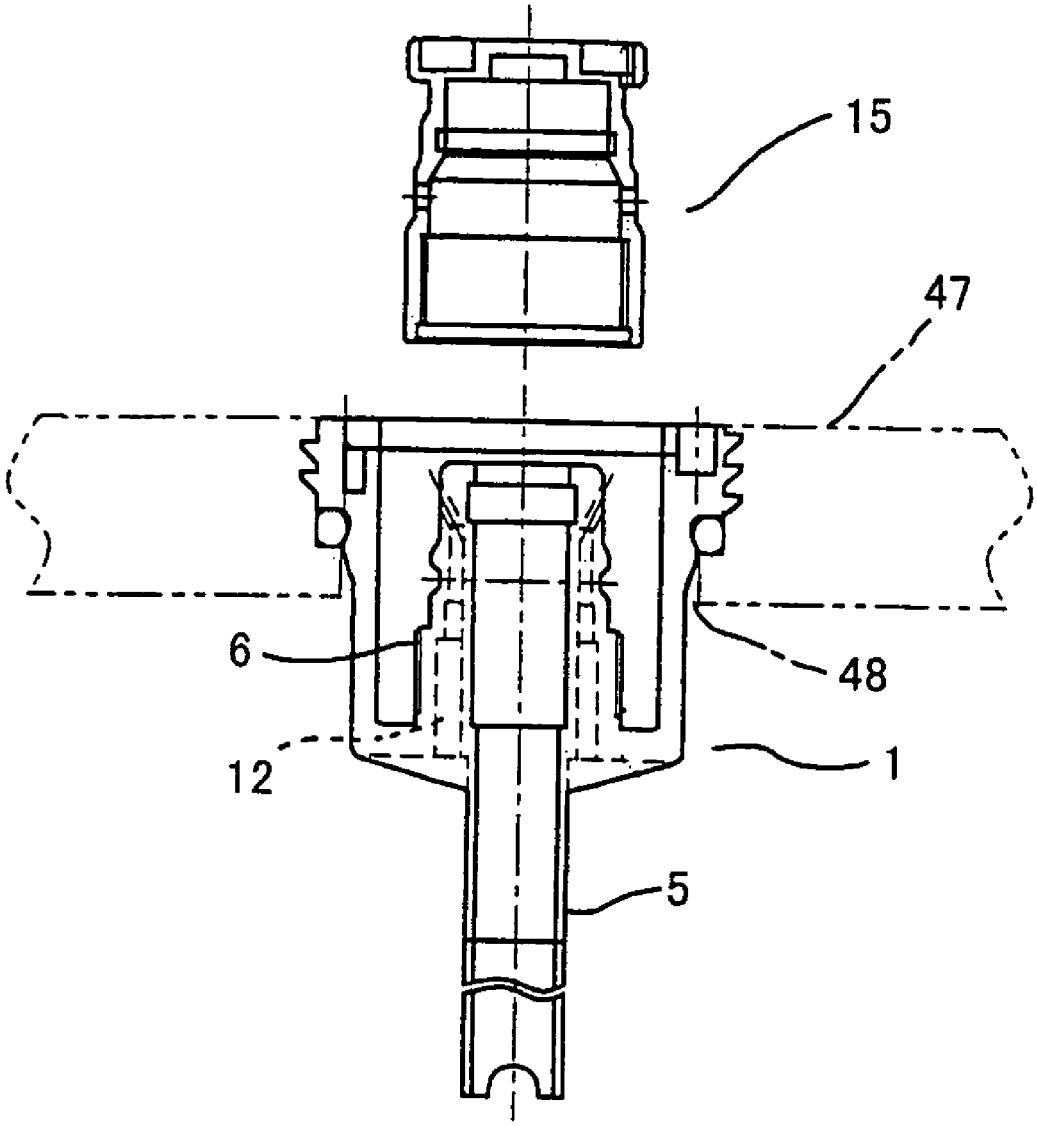
FIG. 5 is a view illustrating a connecting process (a first step) of the plug and the socket in the connector according to the present invention.
Figure 6:
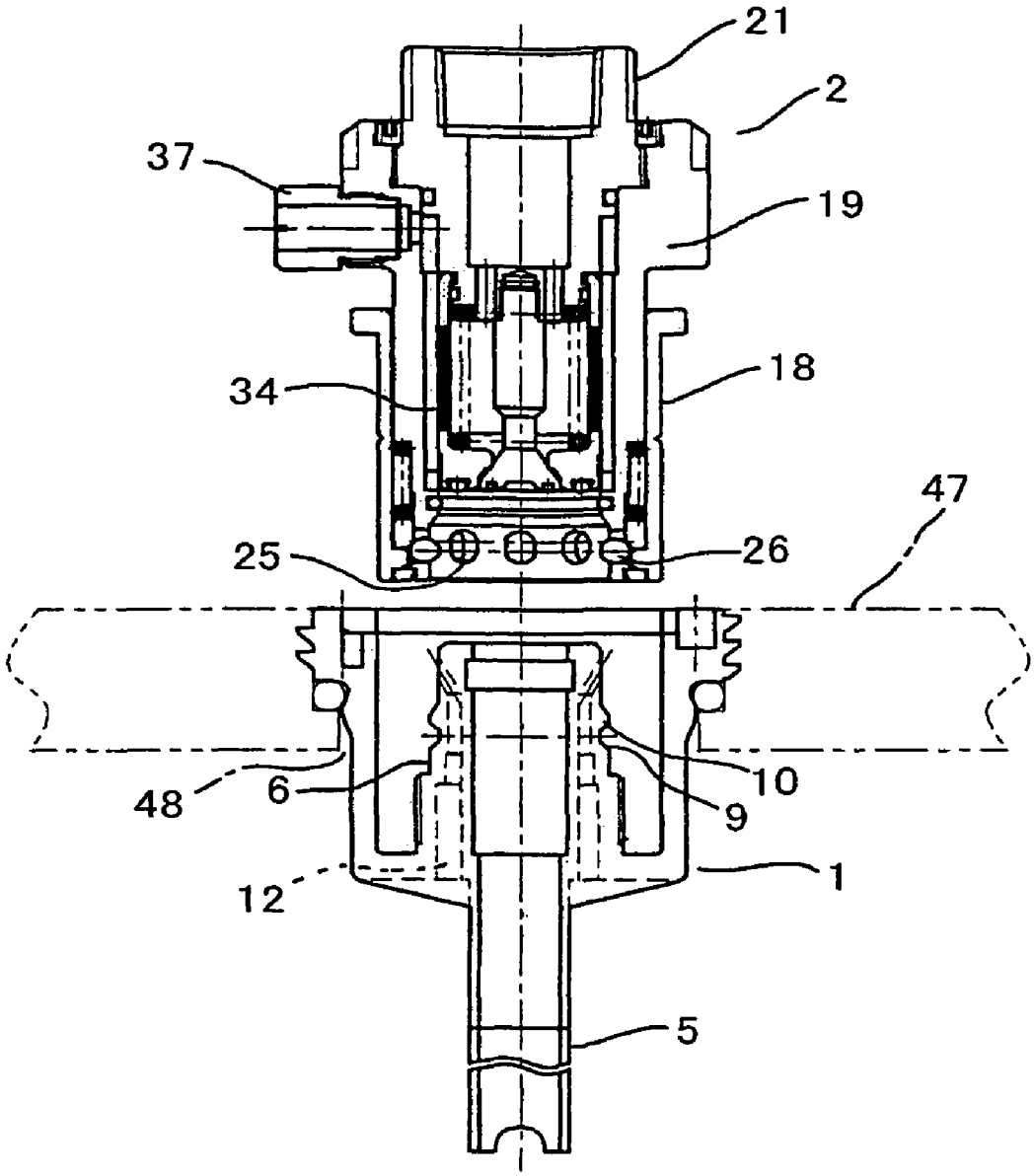
FIG. 6 is a view illustrating a connecting process (a second step) of the plug and the socket in the connector according to the present invention.
Figure 7:
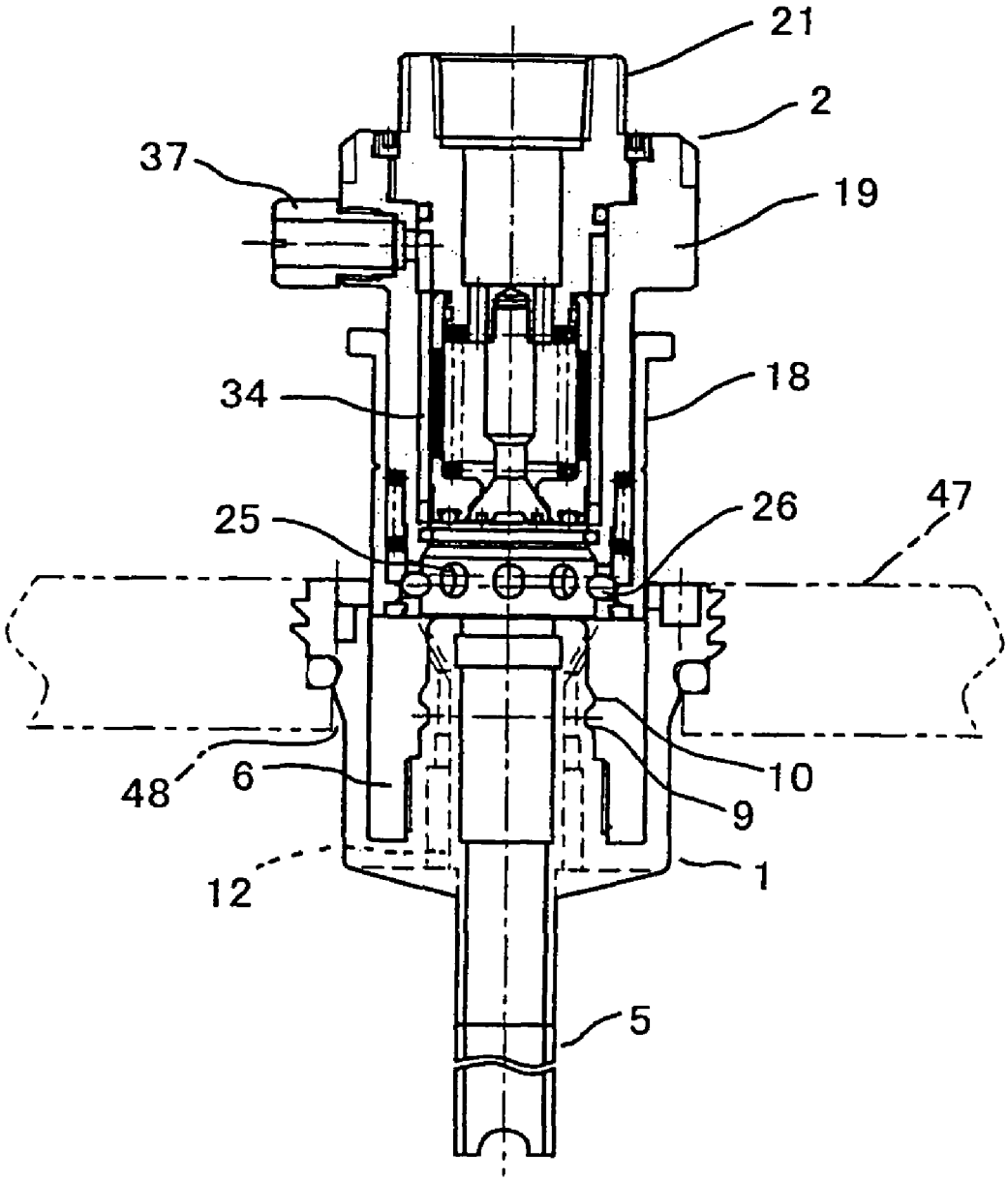
FIG. 7 is a view illustrating a connecting process (a third step) of the plug and the socket in the connector according to the present invention.
Figure 8:
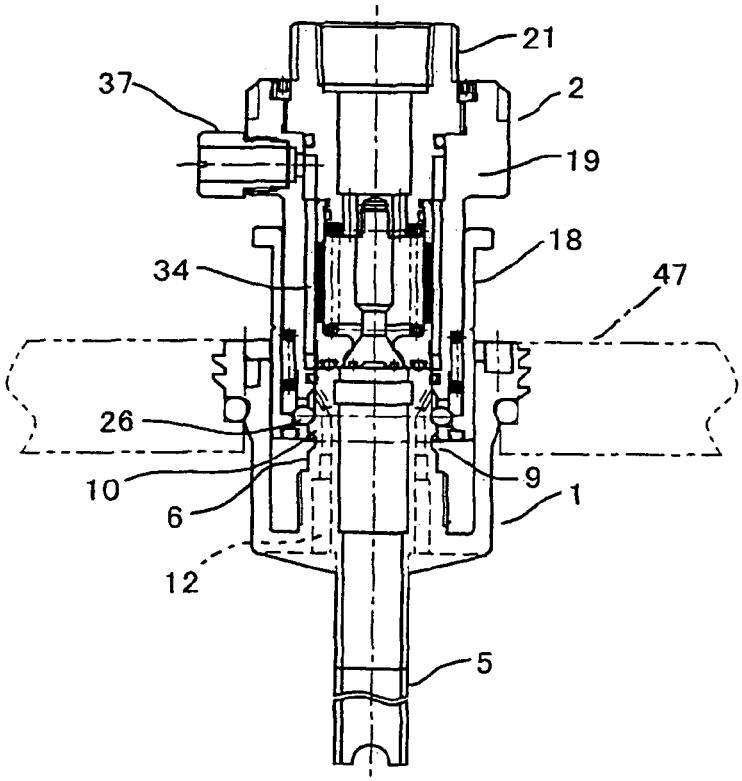
FIG. 8 is a view illustrating a connecting process (a fourth step) of the plug and the socket in the connector according to the present invention.
Figure 9A:
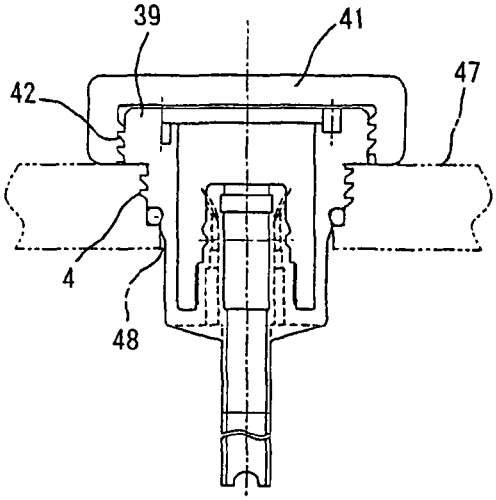
FIG. 9 is a view illustrating in construction an example of the plug provided with the dust-proof cap or dust cap.
Figure 9B:
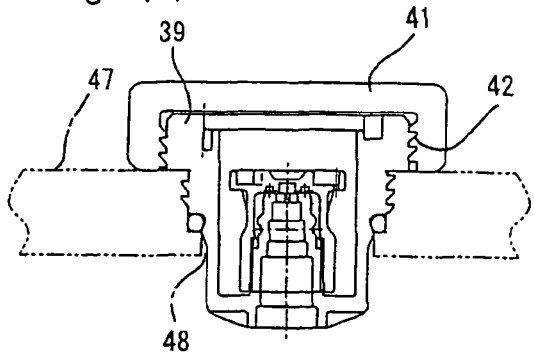
Figure 10:
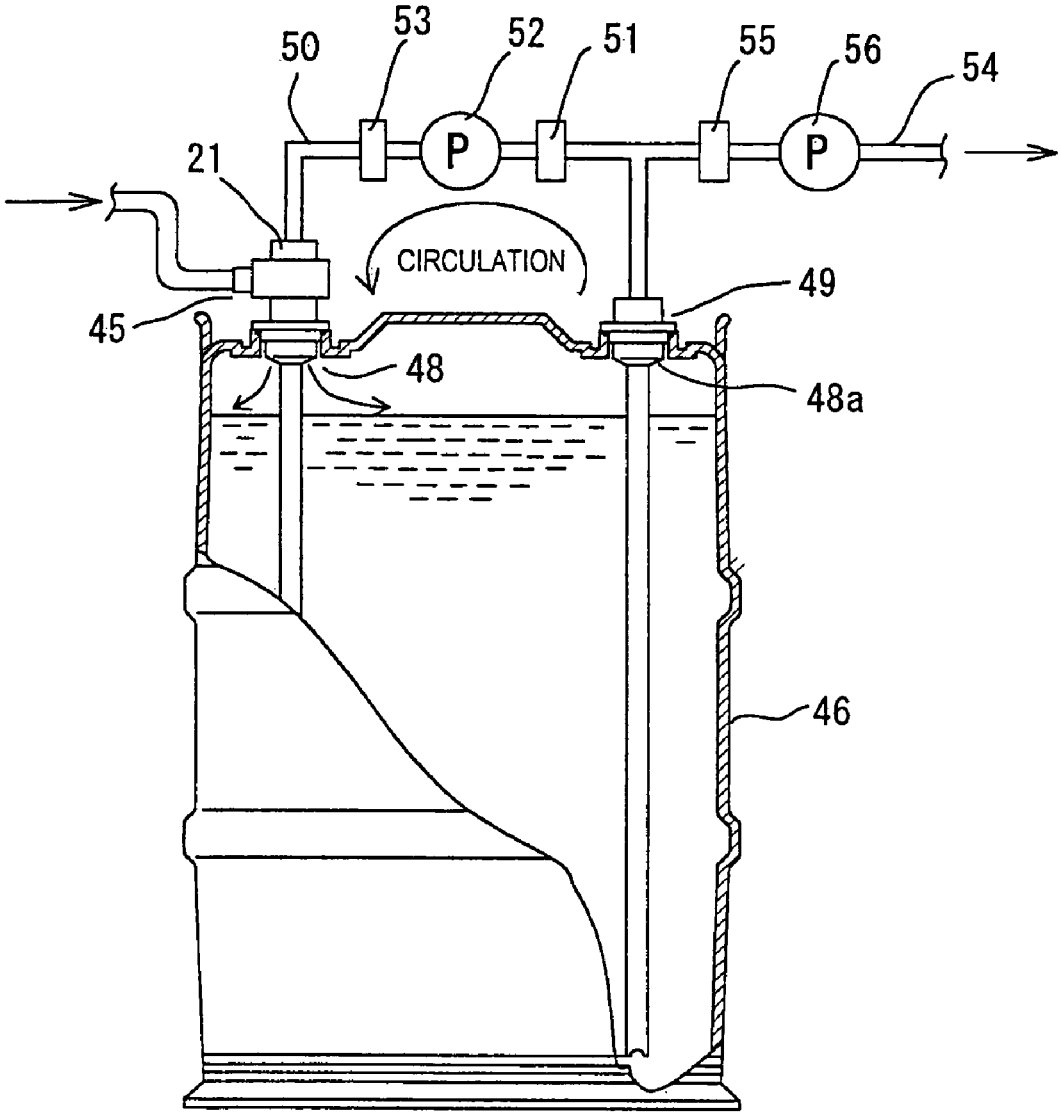
FIG. 10 is a view illustrating in construction an example of the liquid tank according to the present invention.
Figure 11:
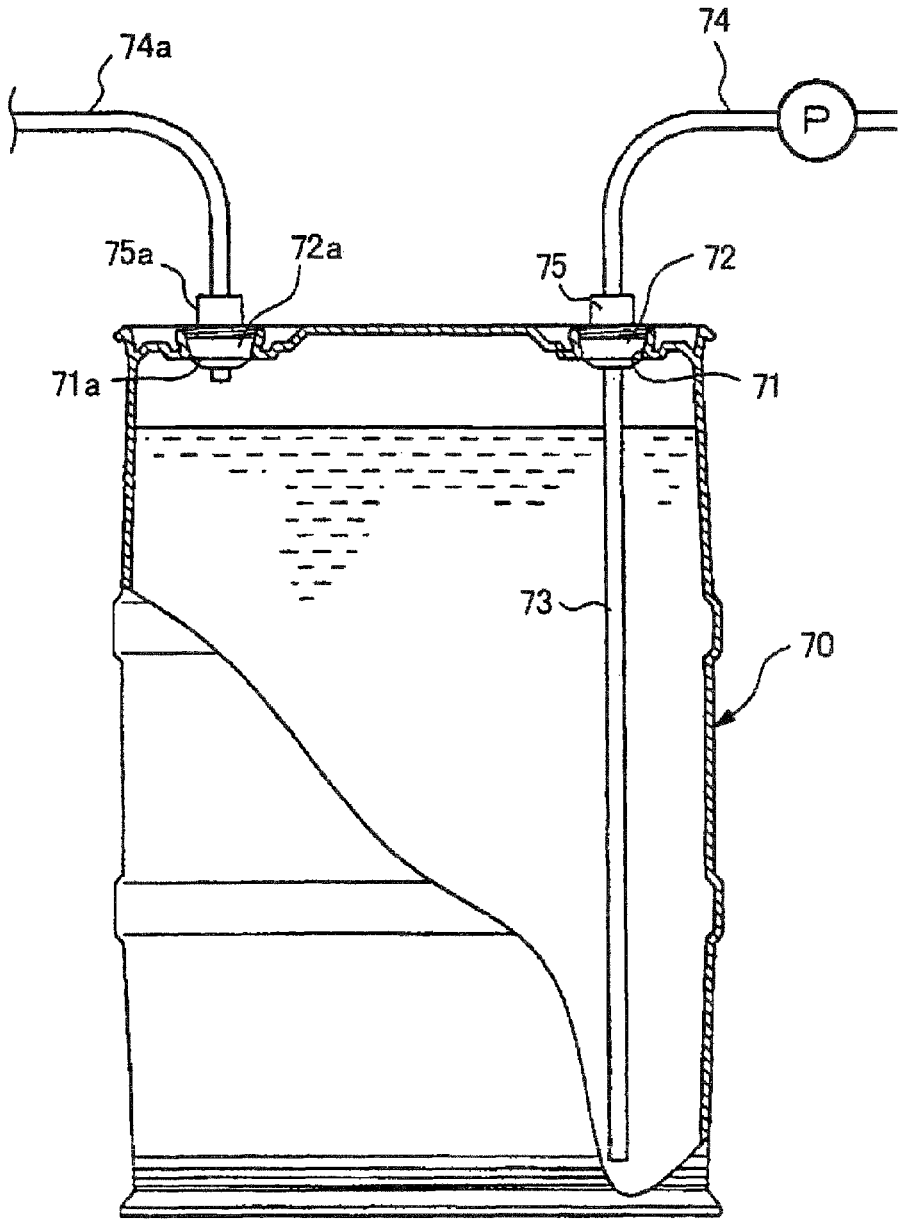
Fig. 11 (Prior Art)
FIG. 11 is a view illustrating in arrangement an example of each of the liquid passage connecting plug and the gas passage connecting plug both connected to the conventional tank.

The invention claimed is:

1. A connector to be attached to a liquid tank for delivery of its internal liquid, comprising:

said connector is constructed of a plug fixedly mounted on said tank and a socket connected with said plug;

said plug is provided with:

a cup-shaped body having a fitting means for fixing to said tank;

a plug tube which has an engagement means engaged with said socket and is vertically provided in a central area of a concave portion of said cup-shaped body with a gap at said plug tube's surrounding area;

a liquid passage and a gas passage formed in said cup-shaped body to vertically pass through said plug tube;

a siphon tube, being a unified portion of said cup-shaped body, integrally formed from the bottom of said cup-shaped body to communicate with the liquid passage; and said socket is provided with:

an engagement means engaging with said plug portion;

a valve unit;

a liquid passage communicated with said liquid passage of said plug tube and a liquid passage connecting piece communicated with said liquid passage of said socket; and a gas passage communicated with said gas passage of said plug tube and a gas passage connecting piece communicated with said gas passage of said socket.

2. A connector to be attached to a liquid tank as set forth in claim 1, wherein said valve unit of said socket is constructed of:

a sleeve element provided with a valve seat in its lower portion;

a valve disposed inside said sleeve element; and a spring for urging said valve seat, wherein said gas passage is so formed as to vertically extend along an outer side of said sleeve element and also to be in communication with said gas passage connecting piece; and when said valve is opened, said liquid passage disposed in the side of said plug is in communication with said liquid passage disposed in the side of said socket, wherein said gas passage disposed in the side of said socket is in communication with said gas passage disposed in the side of said plug.

3. The connector to be attached to said liquid tank as set forth in claim 1 or 2, wherein said plug is provided with a plug cap which covers said plug tube at a time when said socket is not connected.

4. The connector to be attached to said liquid tank as set forth in claim 1 or 2, wherein a color ring is fitted in an opening in an upper surface of said cup-shaped body of said plug, wherein said color ring is classified in color in accordance with the kinds of said liquid in said tank.

5. The connector to be attached to said liquid tank as set forth in claim 1 or 2, wherein a key is formed in an opening in the upper surface of said cup-shaped body of said plug, wherein said key has its installation position varied in accordance with the kind of said liquid stored in said tank.

6. The connector to be attached to said liquid tank as set forth claim 1 or 2, wherein an upper end of said gas passage having been formed in said plug tube is opened into an upper side surface of said plug tube.

7. The connector to be attached to said liquid tank as set forth in claim 2, wherein said socket is constructed of:

a sleeve;

an inner tube, which is slidably inserted in said sleeve and has its inner peripheral surface formed into said gas passage;

said valve unit installed inside said inner tube;

said liquid passage connecting piece, which is screwed from the upper surface of the inner tube for supporting an upper surface of said valve unit; and said gas passage connecting piece mounted on an upper portion of said inner tube.

8. The connector to be attached to said liquid tank as set forth in claim 7, wherein one or a plurality of gas passages are formed in an outer side of said sleeve element, wherein an upper end of each of said gas passages is opened into an annular gap formed between said inner tube and said liquid passage connecting piece.

9. The connector to be attached to said liquid tank as set forth in claim 1 or 2, wherein said cup-shaped body of said plug is provided with a male screw portion as a fitting means to be fixed to said tank in its intermediate portion, wherein said male screw portion is threadably engaged with a mouth stopper portion of an upper surface of said tank, and a bulging portion which bulges out over an edge portion of said mouth stopper portion is provided in an upper portion of said plug, and said bulging portion is covered with a dust protective cap.

10. A liquid tank and a connector attached thereto, comprising:

two pieces of mouth stopper portions in an upper surface of said liquid tank, wherein at least one of said mouth stopper portions is connected with said connector, and wherein said connector is the connector of any one of claim 1 or claim 2 or claim 7, thereby providing a circulation passage for connecting said two connectors.

11. The liquid tank as set forth in claim 10, wherein a valve, a pump and a filter are installed in said circulation liquid passage.

* * * * *